US008820719B2

(12) United States Patent
Ferrari

(10) Patent No.: US 8,820,719 B2
(45) Date of Patent: Sep. 2, 2014

(54) DRAW-WORKS FOR MANEUVERING OF DRILLING DEVICES

(75) Inventor: Stefano Ferrari, Barbiano (IT)

(73) Assignee: Drillmec S.p.A., Gariga di Podenzano (PC) (IT)

( * ) Notice: Subject to any disclaimer, the term of this patent is extended or adjusted under 35 U.S.C. 154(b) by 780 days.

(21) Appl. No.: 13/056,586

(22) PCT Filed: Jul. 29, 2009

(86) PCT No.: PCT/EP2009/005477

§ 371 (c)(1),
(2), (4) Date: Apr. 6, 2011

(87) PCT Pub. No.: WO2010/012455

PCT Pub. Date: Feb. 4, 2010

(65) Prior Publication Data

US 2011/0174540 A1 Jul. 21, 2011

(30) Foreign Application Priority Data

Jul. 30, 2008 (IT) ..... TO2008A0589

(51) Int. Cl.
*B66D 1/14* (2006.01)
*E21B 19/00* (2006.01)
*B66D 1/12* (2006.01)

(52) U.S. Cl.
CPC ..... *E21B 19/008* (2013.01); *B66D 1/12* (2013.01)
USPC ..... 254/340; 254/361

(58) Field of Classification Search
USPC ..... 254/340, 342, 361, 278
See application file for complete search history.

(56) References Cited

U.S. PATENT DOCUMENTS

| | | | | |
|---|---|---|---|---|
| 2,666,876 | A * | 1/1954 | Sinclair | 318/8 |
| 3,698,690 | A * | 10/1972 | Beaver | 254/340 |
| 4,108,280 | A | 8/1978 | Eastcott et al. | |
| 4,432,532 | A | 2/1984 | Overholt | |
| 6,793,203 | B2 | 9/2004 | Heinrichs et al. | |
| 6,848,675 | B2 * | 2/2005 | Davis et al. | 254/340 |
| 6,966,544 | B2 * | 11/2005 | McCormick et al. | 254/342 |

(Continued)

FOREIGN PATENT DOCUMENTS

| | | |
|---|---|---|
| CN | 201173261 | 12/2008 |
| DE | 1 064 001 | 8/1959 |

(Continued)

OTHER PUBLICATIONS

Composite Catalog of Oil Field Equipment and Services, World Oil, vol. 2, pp. 1340-12-1340-13, 1998.

*Primary Examiner* — Emmanuel M Marcelo
(74) *Attorney, Agent, or Firm* — Merchant & Gould P.C.

(57) ABSTRACT

A draw-works (10) is for maneuvering drilling devices that includes a winder (11) for winding at least one rope (12), which is centered on a shaft (13) having one first end and one second end and rotating in one first direction and in one second direction opposite to the first. The winder (11) is at least partially substantially cylindrical in shape. One or more supports (14) rotatably support the shaft (13). Motors (19) are designed to enable rotation in the first direction and in the second direction of the shaft (13) and of the winder (11). The supports (14) and the motors (19) are fixed to a frame base (16). The motors (19) are set on both sides of the winder (11) and connect to them without speed-reducing elements, with direct drive on the shaft (13).

15 Claims, 6 Drawing Sheets

(56) References Cited

U.S. PATENT DOCUMENTS

| | | | | |
|---|---|---|---|---|
| 7,192,010 | B2 * | 3/2007 | Roodenburg et al. | 254/360 |
| 7,862,009 | B2 | 1/2011 | Folk et al. | |
| 8,550,438 | B2 * | 10/2013 | Cilliers | 254/342 |
| 2008/0116432 | A1 * | 5/2008 | Folk et al. | 254/362 |
| 2009/0267426 | A1 * | 10/2009 | Graner et al. | 310/54 |
| 2010/0127229 | A1 * | 5/2010 | Kverneland et al. | 254/356 |
| 2011/0272653 | A1 * | 11/2011 | Cilliers | 254/334 |

FOREIGN PATENT DOCUMENTS

| | | |
|---|---|---|
| DE | 1064001 | 8/1959 |
| DE | 10005075 | 8/2001 |
| EP | 1259455 | 11/2002 |
| WO | 2009156503 | 12/2009 |

* cited by examiner

DRAW-WORKS FOR MANEUVERING OF DRILLING DEVICES

This application is a National Stage Application of PCT/EP2009/005477, filed 29 Jul. 2009, which claims benefit of Serial No. IT2008A000589, filed 30 Jul. 2008 in Italy and which applications are incorporated herein by reference. To the extent appropriate, a claim of priority is made to each of the above disclosed applications.

BACKGROUND OF THE INVENTION

The present invention relates to an electric draw-works, and in particular to a draw-works for the maneuvering of drilling devices.

SUMMARY OF THE INVENTION

It is known that in case of big devices to be hoisted or lowered inside ducts or tunnels in the ground, hoisting and maneuvering draw-works are commonly used.

In particular, in the field of petroliferous working, draw-works are used also for the maneuvering and hoisting of drilling rods, that are afterwards lowered inside the drilling hole.

Draw-works are critical components of drilling rigs, because in the absence of one or more reliable or tough draw-works a drilling rig cannot work neither efficiently nor safely.

Owing to the fact that the draw-works is a necessary component in the most part of conventional drilling rigs, the next paragraph shows a brief description of the most common features and functions associated to a drilling rig.

In detail a drilling rig comprises the following components:

- a drilling tower;
- a fixed tackle, fixed on the top of the above mentioned tower;
- a movable tackle for vertically moving inside the drilling tower and that in detail is hung under the fixed tackle by means of a plurality of ropes passing through a plurality of pulleys;
- one or more draw-works having a winding drum for releasing and reeling a rope by means of which the movable tackle lifts and lowers;
- a top drive hung to the movable tackle and vertically slidable on a plurality of guides fixed upon the drilling tower and designed to put into rotation the drilling battery;
- means for handling and supporting the drilling battery, constituted in its turn by a plurality of drilling rods, and by a bit positioned at the bottom of the hole;
- means for the circulation of a drilling fluid that removes from the bottom of the well the debris generated by the rotation of the bit.

More in detail, the draw-works must carry out the following operations:

- a gradual release of the rope upon which the drilling battery is set, so that to ensure a weight of the bit on the bottom of the hole that remains at a constant value with the increasing of the depth; thus the draw-works must at the same time exert a constant tension on the rope. This tension is used for supporting the top drive and part of the weight of the battery;
- a quick hoisting of the top drive when it is necessary to add rods to the drilling battery;
- a moderately slow elevation of the drilling battery for carrying out the change of the bit and, with the change done, a quick descent up to the point of continuation of the drilling.

Therefore a draw-works for petroliferous applications that is efficient must possess the following features: a finely adjustable and in real time variable rotation speed of the drum; an easy control of the rotation speed of the drum; a control of the torque on the drum for the rope tension that is in real time variable and that is efficient and finely adjustable.

To these features it is added the fact that these draw-works must be commonly provided with service braking devices, that are reliable and long-term, so that to control for instance the descent of loads. Furthermore, the draw-works for drilling rigs must also be provided with braking devices for statically supporting the maximum nominal load if the service brake is out of order, and not least, for having the less maintenance possible along with reduced size and weights.

Finally, considering the specificity of the field within which they operate, the draw-works for drilling rigs must have features consistent with the operation in areas with the risk of explosions.

There are known commercial draw-works 1 for the use in drilling rigs are known, as schematically shown in FIG. 1, that provide for a power source 2 (in most cases electrical) adjacently positioned to a drum 3 and is coupled to a gearcase 4 through cardan shafts 5, coupler joints, transmissions and clutches so that to modify the speed with whom the drum 3 is wound.

These kinds of actuation of the draw-works 1 are not convenient and in fact they present some disadvantages; first of all, the power source 2 occupies a lot of space, is noisy and represents a risk for people who operate in the neighborhoods. Secondly, furthermore, the gearcase 4 that represents the speed gear box is subject to expensive and frequent maintenance and certainly contributes to a rise of the breaking risk of the draw-works 1 components.

Finally, the use of many mechanical parts limits the efficiency of the mechanical performance of the draw-works 1. The transmission chains are subject to peaks of stress during the work that can cause the breaking of the chain, with disastrous consequences that must be absolutely avoided in the field of petroliferous drillings.

According to the document U.S. Pat. No. 6,793,203 on behalf of Wirth Maschinenbau, there are also known draw-works comprising two direct current electric motors (DC motors) paired to speed gear boxes whose output shaft bears a pinion in its turn engaged with a toothed wheel integral with the drum. Upon these motors, on one of the two drum sides are installed brake disks and an eddy-current brake.

The draw-works is also provided with a supply device constituted by a low power electric motor paired to a high reduction ratio reducer unit, that permits to partly act as brake during the unreeling of the drum cable.

Another development of the draw-works for being used in drilling rigs has been provided by the use of alternating current motors in comparison to the direct current motor; the alternating current motors namely present a torque higher than the one that is possible to obtain from direct current motors, in particular with a very low RPM. With reference to FIG. 3, that represents a graph of the torque of an alternating current electric motor with the increasing of the RPM, according to an intermittent cycle 6, and according to a continuous cycle 7.

According to the document US 2008/0116432 is also known that there are electric draw-works for the reeling and the unreeling of cables that, for obviating to the solution of the encumbrance, present an electric motor mounted inside the rotating drum of the draw-works. This solution, however, is not free from disadvantages, because it is known that the efficiency of an electric motor decreases with the increasing of the temperature of its windings.

In fact, the efficiency of an electric motor depends upon the resistance that the electric current meets when flowing in the windings during the functioning of the motor itself; in particular, the more the electric resistance increases the larger will be the losses caused by the Joule effect and, consequently the total efficiency will decrease.

The graph of FIG. 2 shows in detail an example of how the electric resistance increases with the increasing of the temperature of the windings of an electric motor. With an increase of 100° C. in their temperature, there is even a doubling of the ohmic losses.

Furthermore, the torque of the motor, that depends on quadratic law upon its external diameter, is conditioned by the inner size of the drum of the draw-works.

It is for this reason that the installation of a motor inside a drum meets many problems from the point of view of the cooling and of the produced torque, with the serious risk of incurring into breaking of the motor because of the overtemperature.

The purpose of the present invention is to realize a draw-works for the maneuvering of drilling devices, that is free from the above described disadvantages.

BRIEF DESCRIPTION OF THE DRAWINGS

The invention will be now described with reference to the appended drawings, that illustrate a not restrictive example of embodiment, wherein:

the FIG. 1 shows a draw-works with a reduction system through gears and chains of known kind;

Figure 1:
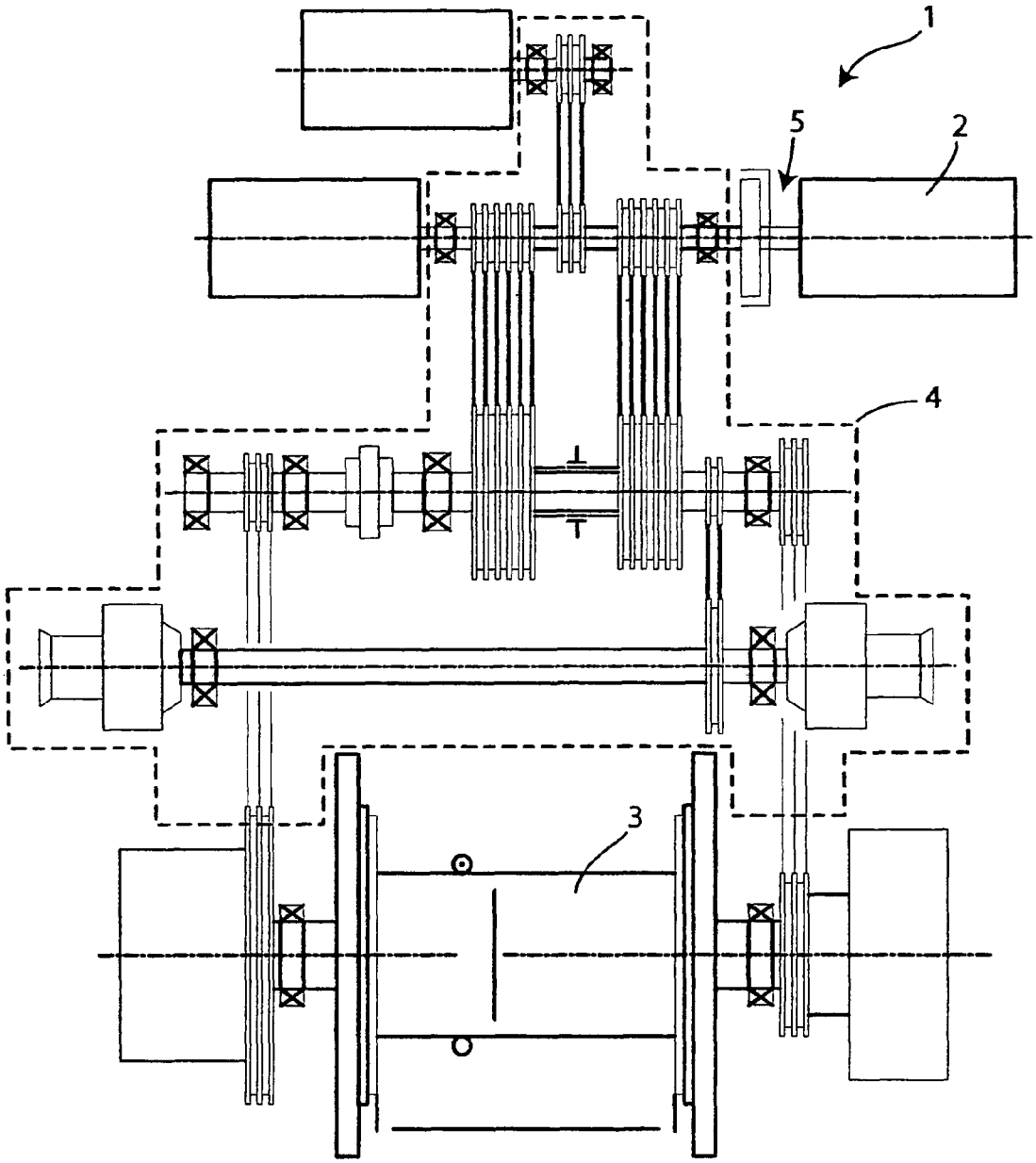
Figure 2:
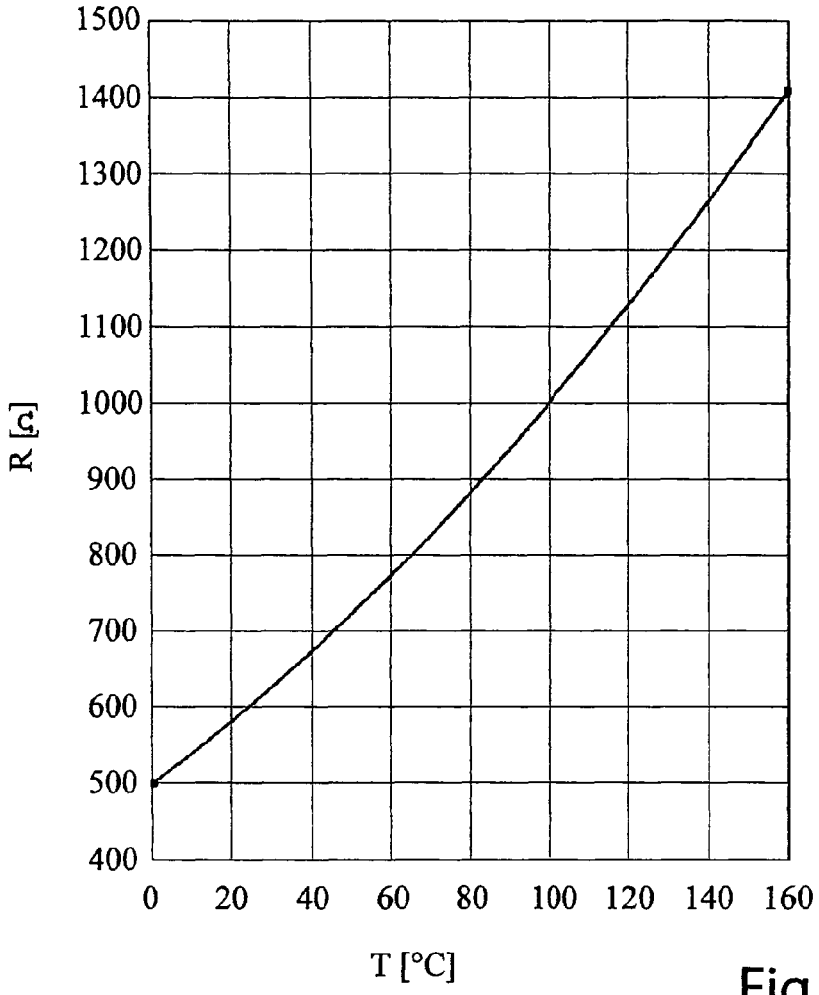
Figure 3:
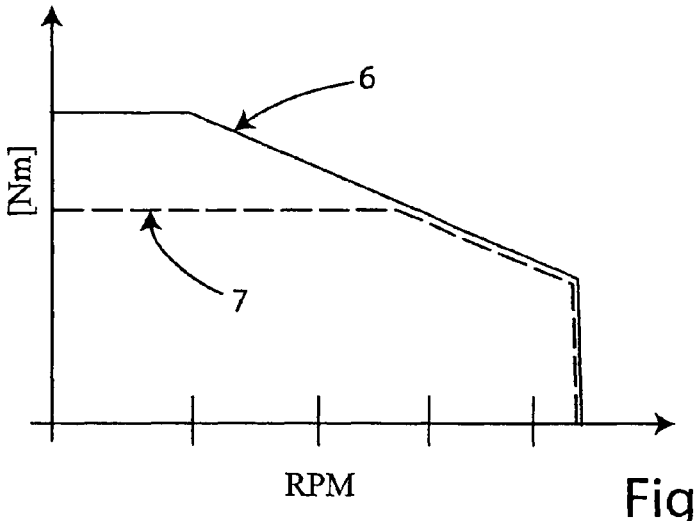
Figure 4:
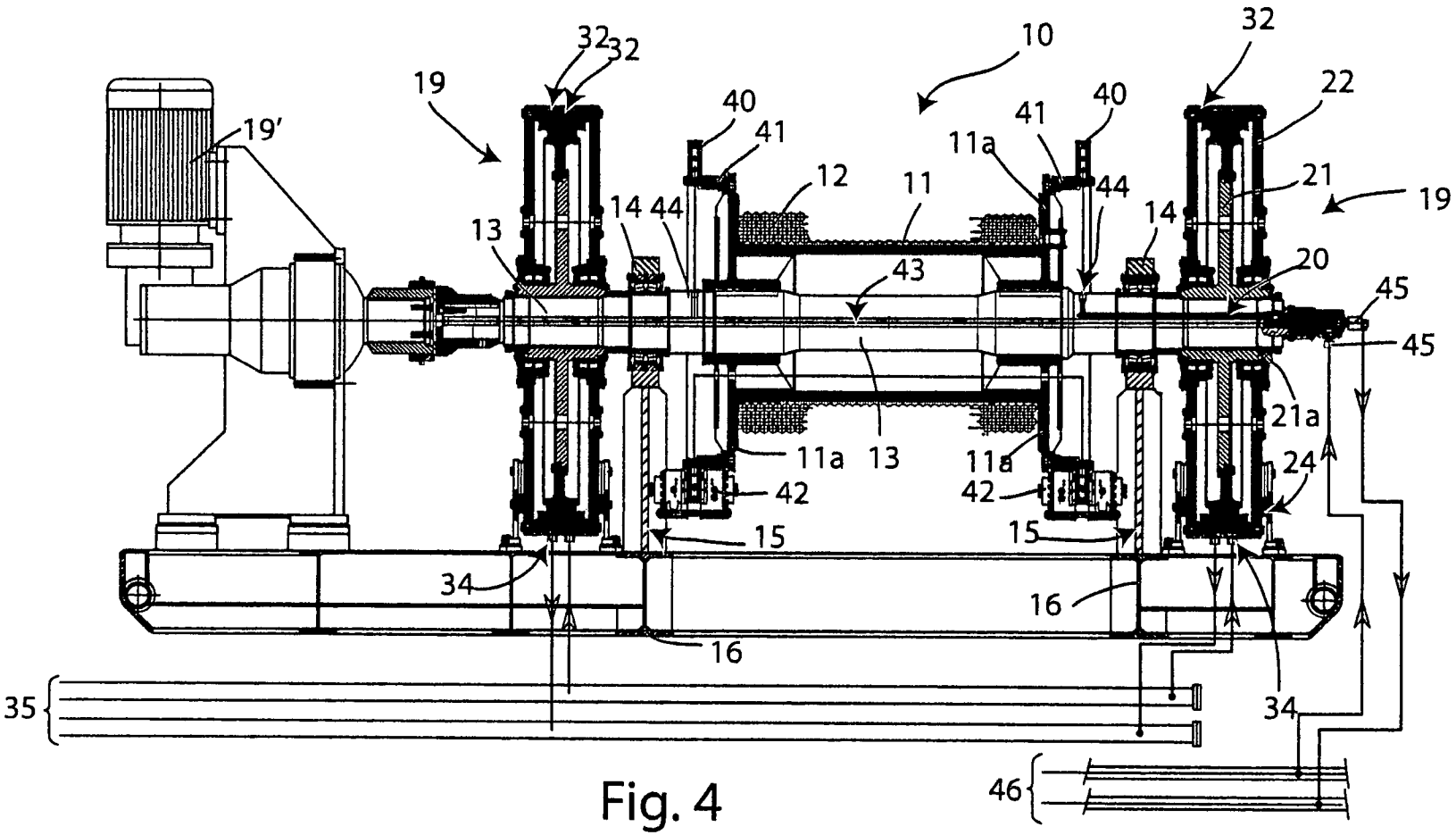
Figure 5:
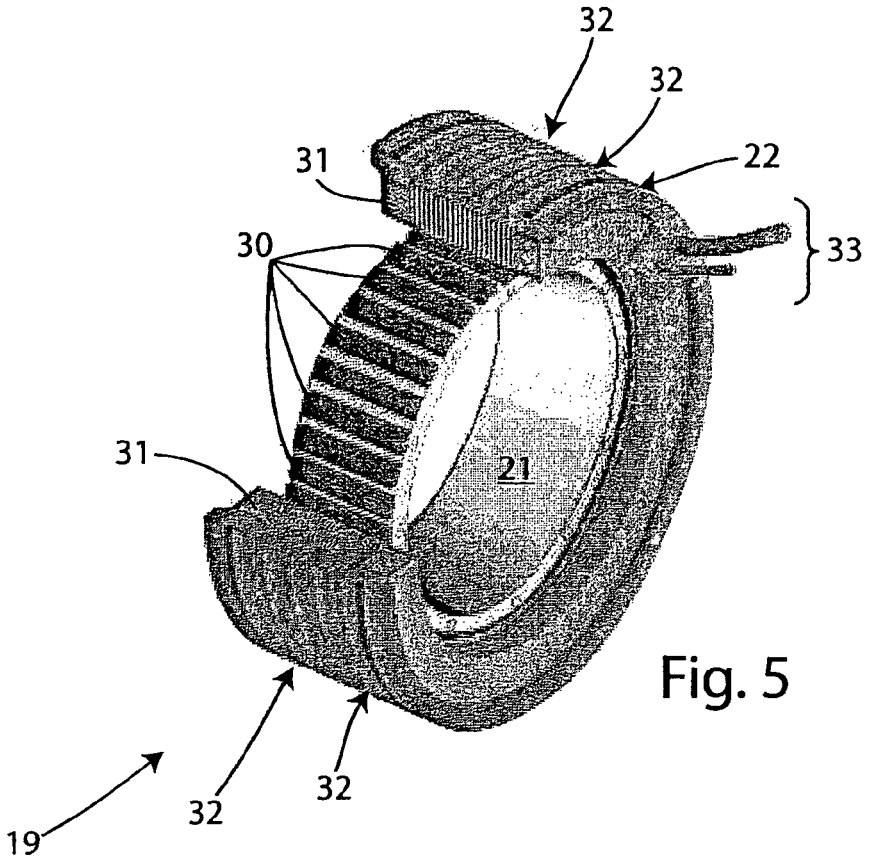
Figure 6:
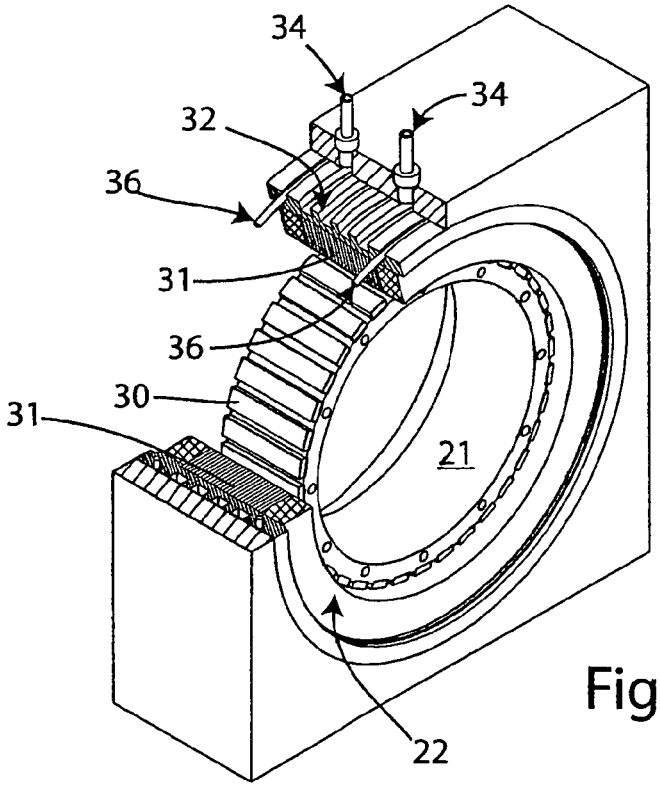
Figure 7:
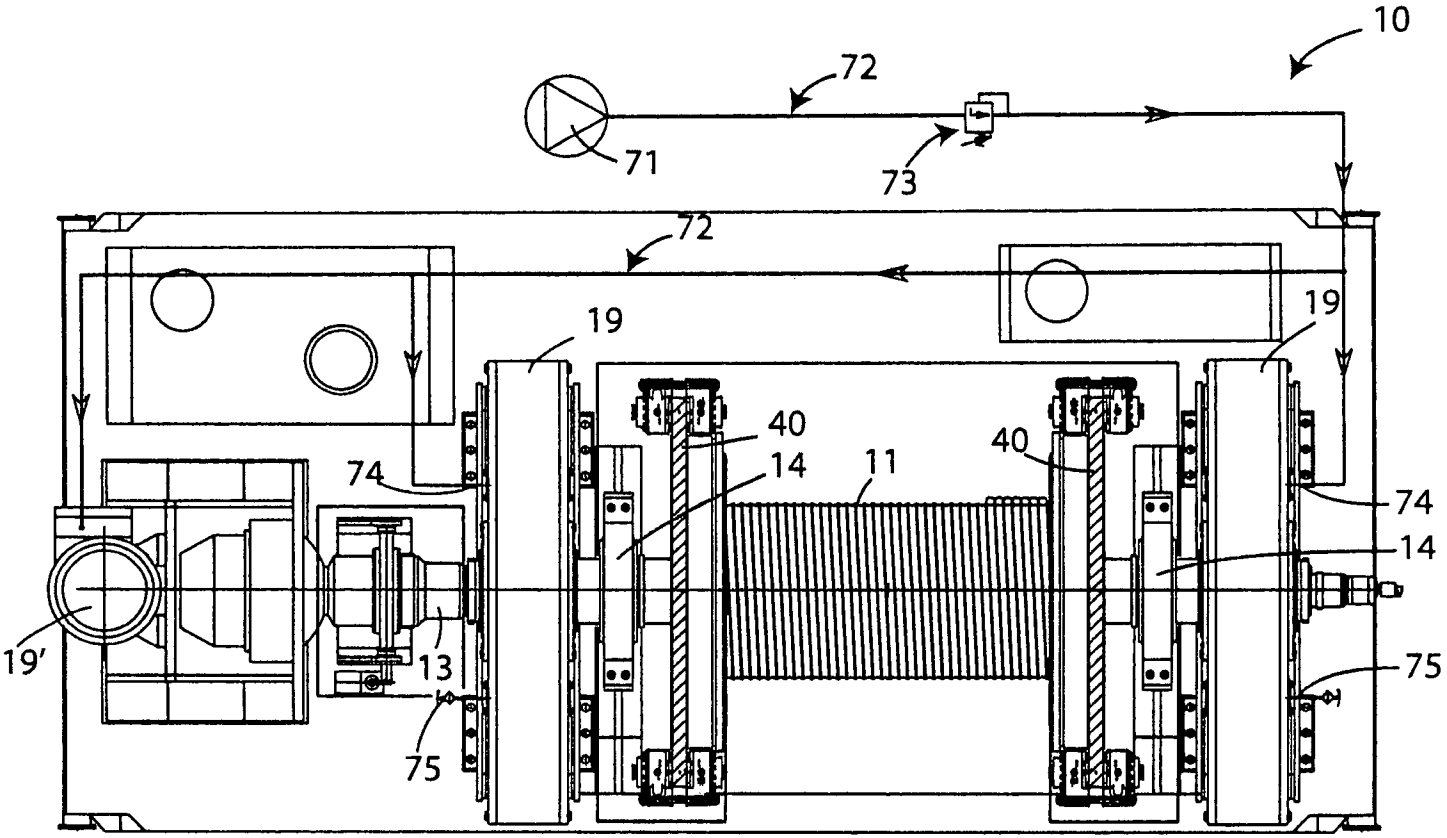
Figure 8:
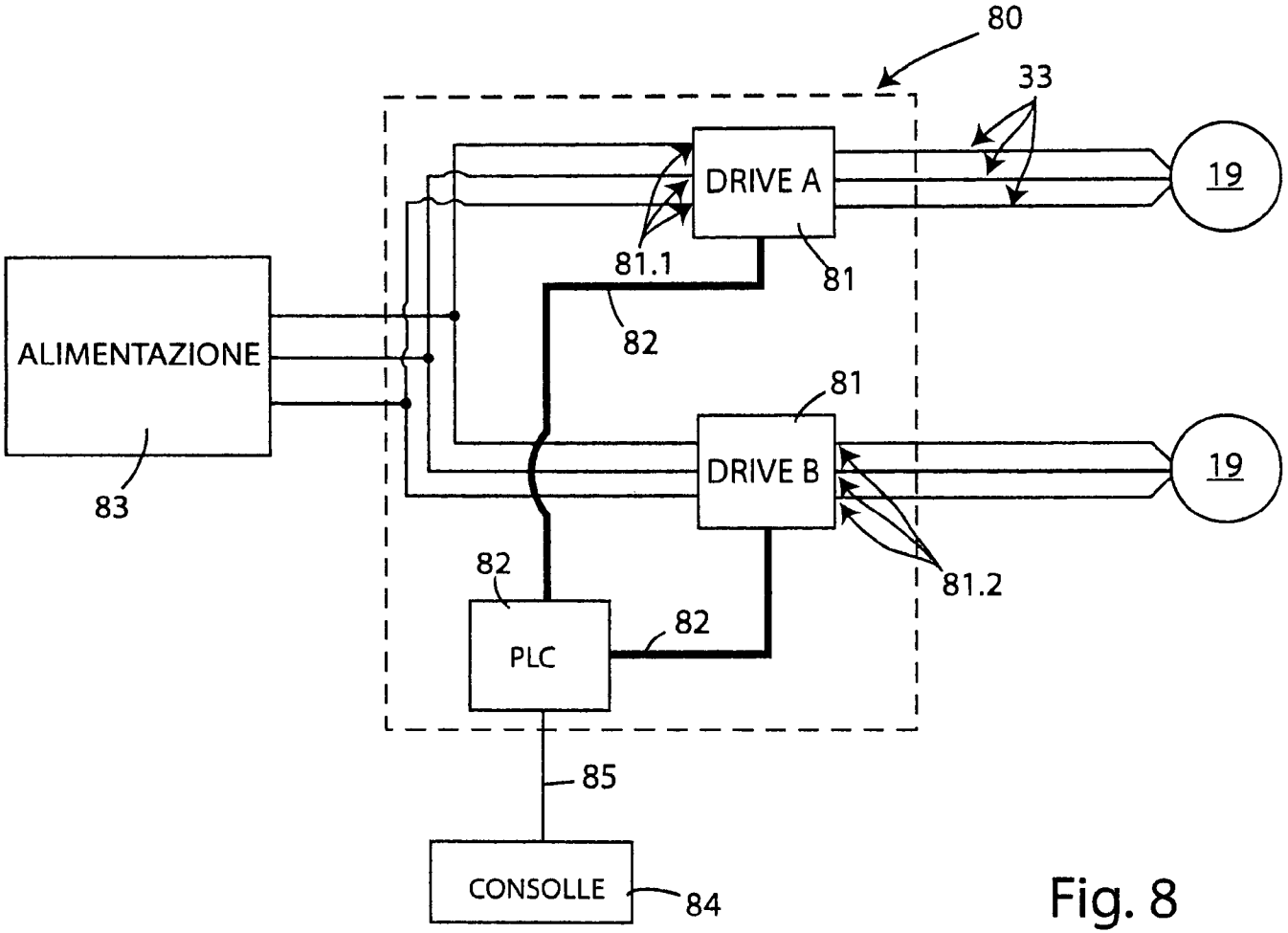

the FIG. 2 shows a graphic that compares an electric resistance of winding of an electric motor for draw-works to the temperature of the same;

the FIG. 3 shows a torque diagram as referred to the rotation speed of an electric motor;

the FIG. 4 shows a side view of a preferred embodiment of a draw-works according to the present invention;

the FIG. 5 shows a section of an electric motor used in the draw-works of FIG. 4;

in FIG. 6 it is shown a second section of an electric motor used in the draw-works of FIG. 4;

in FIG. 7 it is shown a mechanic-idraulic scheme of the draw-works of FIG. 4;

in FIG. 8 it is shown a wiring diagram of a supply and control system of the draw-works of FIG. 4.

DETAILED DESCRIPTION OF THE PREFERRED EMBODIMENT(S)

With reference to FIG. 4, a draw-works for the maneuvering of drilling devices is generally designated with the reference number 10; it comprises a drum 11 for housing a rope 12 designed to hoist and lower a drilling device (not shown).

The rope 12 must be of such a strength in order to bear the weight of the drilling device with a safety margin before its breaking; this margin is sometimes determined by regulations that can vary according to the destination of the present invention. It is for this reason that the rope 12 is preferably constituted at least partly in metal, is typically formed by many strands wound on under-ropes and can present an external covering shell for preventing the etching of metal oxidizing agents.

The drum 11, of substantially cylindrical shape and provided with flaps 11*a* in correspondence to two terminal ends designed to contain in an area delimited among them the metallic rope 12, is rigidly connected to a main shaft 13 of rotating type, that is supported at its first and second end by a first plurality of bearings 14, respectively arranged on sides 15 belonging to a support frame 16.

More in detail, the main shaft 13 and the first plurality of bearings 14 can be realized with any materials for bearing the weight combined of the drum 11, of the cable 12 and, also, must be able to withstand the torque provided by the electric motors 19 and the dynamic loads of braking exerted by the cable 12 without cracking or breaking. It is for this reason that it is advisable to use high-strength steel alloys in their realization.

The draw-works 10 also comprises two electric motors 19, that can concordantly rotate in a first clockwise and in a second counterclockwise rotation and are mounted in a manner so that to permit to the main shaft 13, and therefore to the drum 11, to rotate with them without interference of gearcases or other speed reduction means, thus resulting particularly easy concerning the construction and, also, silent.

More in detail, the electric motors 19, that comprise a rotor 21 and a stator 22, are keyed on the main shaft 13 outside the sides 15 on a respective groove 20, so that the rotor 21 integrally rotate with the main shaft 13 without the interference of any kind of reduction means or variation in speed such as gearboxes or similar devices. This positioning permits an easy installation of the electric motors 19 and their quick replacement if the working requirements change during the life cycle of the draw-works 10 (for example, the need of a torque of more powerful electric motors) without affecting the rest of the structure of the draw-works 10 and, in particular, without changing the structure of the drum 11.

The stator 22, that is arranged outside the rotor 21 and "wraps" it acting as a cover, is coupled even it to the rotor 21 through a second plurality of bearings 23 but is fixed to the support frame 16 through the brackets 24 that are rigidly connected to it, preferably by means of a screw coupling and bolts. In fact, the use of screws and bolts, permits the disassembly and removal or replacement of a motor 19 eventually damaged or, furthermore, of a component of the drum 11.

As far as the electric motors 19 are concerned, they are of permanent magnets type and without brushes (brushless), and are also known with the terms DC brushless motors or permanent magnets synchronous motors or, also, with the term torque motors.

With reference to FIG. 5, the electric motors 19 of this type are characterized by the presence of permanent magnets 30 radially arranged on the rotor 21 so that to result substantially aligned along a unique direction, whereas the stator 22 is of strips type 31, that face the rotor 21 and are positioned in a more inner area of the stator 22.

In the external part of the stator 22 it is provided a plurality of annular channels 32 that permit the cooling of the electric motor 19 and supply cables 33. More in detail, the annular channels 32 are leaktight maintained by a plurality of fittings 36 for preventing the fact that the cooling fluid contained in them exits and expands outside the motor 19; furthermore the annular channels 32 communicate with pipe fittings 34, shown in FIG. 4 and in FIG. 6, that are arranged on the stator 22, protrude outside the electric motor 19 and are designed to be connected to a first plurality of pipes 35 for the circulation of cooling fluid, that are connected to both the electric motors 19.

The characteristics of electric motors 19 used for the maneuvering of the draw-works 10 according to the present invention is given also by their physical dimensions; in fact, these electric motors 19 possess a relatively high diameter-length ratio and, with respect to other types of electric motor, they also possess a very reduced radial thickness. In fact, their external diameter Di is wide nearly as much as an external diameter Do, and for the connection of the rotor 21 to relatively small shafts, as for example the main shaft 13, reduction flanges 21*a* are used.

Between the rotor 21 and the stator 22 there is an air casing that ensures ease of use in the alignment of components of the motor and a better cooling.

The electric motor 19 provided with this technology present a very reduced time constant, with consequent very quick dynamic response, very wide pass band, a high efficiency deriving from the use of permanent magnets and a high speed associated to a control capability of the magnetic flux that establishes between the rotor 21 and the stator 22; eventually, the electric motors 19 of the described type present a capability to develop a maximum rotation torque almost coincident to the minimum possible rotation speed.

Furthermore, one of the characteristics of permanent magnets and brushless electric motors 19 such as the ones used in the present invention, is the reduced RPM in comparison to other types of electric motor (typically they rotate much lower than 1000 RPM as maximum rotation speed). It is for this reason that they are able to run without the interference of reduction means toward the drum 11. As well as for any electric motor, also the electric motors 19 can act as generators and contribute to the braking of the drum 11 during the unreeling of the rope 12, in particular case of emergency. In this case the electric motors 19 present their supply cables 33 electrically connected to one or more appropriately dimensioned resistors.

The draw-works 10 also comprises means for braking the drum 11, designed to slow down the rotation both in collaboration with the braking force of the electric motors 19 both autonomously, for example after a damaging of the electric motors 19 themselves.

In detail, first of all the draw-works 10 comprises a couple of brake disks 40, arranged and fixed for example through a plurality of screws 41 to the drum 11, so that to integrally rotate with it. These brake disks 40 are designed to slow down the rotation of the drum 11 when the resisting torque offered by the electric motors 19 is not enough to maintain the desired rotation speed of the drum 11. In this case, obviously, the electric motors 19 do not receive electric current but they substantially act as electric generators.

Each brake disk 40 is coupled to a respective brake caliper 42 that is preferably fixed to the frame 16 so that to result fixed to it.

The brake calipers 42 are conveniently operated by an hydraulic circuit and can be of fixed, floating or semifloating type.

These brake disks 40 are of active cooling type and self-ventilated. In fact, they are cooled not only through their rotation because of the air circulation, but also through a fluid (for example, but not limiting to it, water, glycol or oil) that is put in and through a channel 43 inside the main shaft 13, arranged in direction of the axis of the main shaft 13 and having an entry and an exit channel, that are connected to:

- a plurality of outlets 44 designed to put in the cooling liquid near the tracks of the brake disks 40; and
- a second plurality of pipe fittings 45 connected to a second plurality of pipes 46 that are connected to a circulation pump (not shown for the sake of simplicity of representation in FIG. 4).

Secondly, the draw-works 10 presents safety auxiliary brakes (not shown), designed to intervene by blocking the rotation of the drum 11 of the draw-works 10 in case of breakdown. These braking systems are of substantial importance for draw-works designed to be used in drilling rigs, because in case of heavy loads hung to the rope 12 and in case of a sudden lacking of supply to the electric motors 19 and/or breakdown of the service brakes, the rope 12 can unreel at a speed too high despite the magnetic braking effect (dynamo effect) of the electric motors, with the consequent catastrophic breaking of the top drive and of other components of the drilling system. The safety auxiliary brakes intervene by substantially instantaneously blocking the rotation of the drum 11 at the detection of the breakdown (for example through an electric current sensor positioned on the supply cables 33 of the draw-works 10).

Even if the permanent magnets motors permit an excellent control of the torque also at very low speed, in order not to overload the electric motors 19 during the drilling, the draw-works 10 is also provided with an automatic drilling system comprising:

- an autonomous control system for the unreeling of the rope 12 during the drilling;
- a third conventional a.c. and low-power electric motor 19' (typically around 30 kW);
- an automatically operable joint with teeth, that transmits the motion of the main shaft 13 from the third electric motor 19' to the drum 11.

The automatic drilling system constitutes also an emergency operation of the draw-works 10 in case of breakdowns of the electric motors 19 and can operate in three different modes:

- a first "constant load" mode, in which the automatic drilling system detects the force with which the drilling bit presses on the bottom of the drill hole and regulates this force at a value to be kept constant;
- a second "constant-speed" mode, with which the drum 11 has a constant rotation speed and consequently the drilling battery has a descent speed that is constant and independent of the pressure of the bit on the bottom of the drill hole;
- a third "constant-fluid-pressure" mode, with which the rotation speed of the drum 11 and also the descent speed of the drilling battery is regulated in such a way that the pressure of a fluid used for rotating the drilling bit, through a so called bottom-hole motor (not shown), is kept constant.

The draw-works 10 is also provided with a ventilation system 50 of the electric motors 19, designed to permit the operation in areas with the risk of explosions.

More in detail, with reference to FIG. 4 (as for the mechanical disposition) and to FIG. 7 (as for a circuital-mechanical hybrid view), the ventilation system 50 permits also the pressurization of the area inside the stator 22 of the electric motors 19, and comprises:

- a remote fan 70 connected to a duct 72 provided with an adjustable pressure reduction valve 73;
- entry connection pipe fittings 74 and exit filters 75 designed, respectively, to receive the pressured air from the ducts 72 and to discharge the air from the electric motors 19 and from the third motor 19'.

In detail, during the drilling, the remote fan 70 draws the air from a remote area with respect to the draw-works 10, that is typically mounted very near to the center of the well and send it to the drilling deck upon which the draw-works 10 is installed.

On the other hand, the pressure reduction valve 73 is arranged near the electric motors 19 and preferably reduces the pressure of the air send to the frames of the electric motors 19 at a pressure conveniently 1 bar or less higher than the atmospheric pressure. The air, once put in the electric motors 19, exits through the exit filters 75 and is then dispersed in the area surrounding the drawing well.

In detail during the drilling the pressure existing inside the frames, relatively higher than the atmospheric one, does not permit the contact between the atmosphere of the areas immediately adjacent to the well with the inner side of the electric motors 19. In fact, this atmosphere can be characterized by the presence of highly inflammable or—even worse—explosive gas mixtures in a not marginal way.

In fact, even though the brushless motors present a less risk of primer of electric sparks during their functioning in comparison to the electric motors using brushes, this risk is nonetheless excludable, and it is for this reason that a frame of the electric motors 19 is used insulated from the surrounding environment. The presence of a pressure higher than the atmospheric one inside the frames of the electric motors 19 prevents even more the risk of inflammable gas entry into the motor.

From a controllistic point of view, the electric motors 19 of the draw-works 10 are arranged in such a way that they permit the continuous and precise adjustment of the rotation speed and of the torque.

With reference to FIG. 8, the control of the electric motors 19 is carried out through a control net 80 that comprises at least a controller (or drive) 81 for each motor 19 and a programmable logic controller electrically connected through one or more cables for data exchange 82 to each one of the controllers 81.

More in detail each controller 81 possesses:

one or more inputs 81.1 directly connected to an external electrical power supply 83; and one or more outputs 81.2 directly connected the electric motors 19;

and is designed to regulate the rotation speed of the respective electric motor 19 on the basis of the electric signals deriving from the programmable logic controller 81, as well as to carry out secondary functions such as preventing the overload and acting as current limiter or also, to act as transformer from c.c. to a.c.

More in detail, through the programmable logic controller 81 the speed and the torque of the electric motors 19 are continuously monitored through the use of two independent sensors. On the basis of the values of voltage and torque provided by the controllers 81, the programmable logic controller 81 sends a signal to the controllers 81 designed to increase or diminish the value of the electric current delivered to the electric motors 19.

The electric motors 19 are controlled through a PWM, Pulse Width Modulation.

The Pulse Width Modulation stands for supplying an electric motor with a voltage having a square wave form with fixed frequency (from a few kHz up to 20 kHz) and variable Duty Cycle.

In fact, the Duty Cycle d is defined as the ratio between a time interval $\tau$ wherein the square wave is at a first high level and a period T of the square wave itself (T is the inverse of the frequency, and $T-\tau$ is the time interval wherein the square wave is at a second low level). As the duty cycle varies, the mean value of the voltage applied to the electric motor varies (this value is easily inferable by means of an integration on one or more periods of the wave form).

Basically, the motor "feels" the mean value of the voltage and the speed and the torque provided by the motor depend therefore on the mean value of the voltage itself.

On the other hand, in order to reverse the direction of rotation of a permanent magnets c.c. motor, it is necessary to reverse the polarity of the armature voltage.

The programmable logic controller 81 is also provided with monitoring and diagnostic systems that are designed to check that the draw-works 10 and in particular the electric motors 19 and the controllers 81 correctly operate. If it is not so, the programmable logic controller 81 generates an alarm signal (for example activates a visual or sound signal) and, furthermore, it can manage the switching of the supply cables 33 of the electric motors 19 when there is a breakdown of the system of service braking, in order to use the electric motors 19 as emergency brake.

Finally, the programmable logic controller 81 is connected to a control console 84 through a control cable 85; the control console is substantially the user interface with which one or more operators can regulate for example but not limiting to it, the direction of rotation of the electric motors 19, their rotation speed, their torque and braking.

The advantages of the present invention are clear from the previous description. In detail, the draw-works according to the present invention permits to equally distribute the torsion load on the main shaft to both the sides of the drum 11, thanks to the presence of two electric motors 19, arranged one for each side. The equal load distribution is also given by the presence of a couple of braking systems constituted by disks 40 and calipers 42, in their turn arranged one for each side of the drum 11 of the draw-works 10.

These electric motors 19 are simple in their realization and, because of their constructive typology, they permit to produce strong torques of rotation at a low RPM and, at the same time, permit a very accurate regulation of their rotation speed.

It is for this reason that reduction structures such as gear changes, mechanical organs of reduction, toothed wheels or chains designed to vary the ratio between the rotation speed of the drum 11 and the one of the electric motors 19 are not necessary; in this way, greater advantages are obtained, in terms of operation noiselessness, reduction of the production cost and of the number of parts substantially at risk of breakdown and wear and a reduction of the encumbrance of the draw-works itself.

Another advantage is due to the fact that the electric motors 19 possess a particularly limited longitudinal development and this helps the reduction of the overall dimensions of the draw-works 10, as well as the reduction of its weight.

The draw-works 10 described up to this point can also operate in areas at a high risk of fire and explosion, thanks to the presence of a pressurization system of the electric motors 19 and of the third electric motor 19' and is designed to operate also in areas at a high temperature because the electric motors 19 are actively cooled.

Some changes can be carried out to the device described up to this point. In detail, the connections among the controllers 81 and the programmable logic controller 81 can be carried out through wireless technologies; the brake disks 40 can be arranged in couples on each side of the drum 11 and the conventional motors studied for the drilling operations can be arranged in couple, one for each side of the draw-works 10.

The rope 12 can also be formed by a couple of elements, or be double or triple, or can be realized in synthetic material or mixed synthetic/natural material instead of steel.

Barzanò & Zanardo Milano S.p.A.

The invention claimed is:

1. A draw-works for maneuvering drilling rods comprising:

means for winding at least one cable, which are centered on a shaft that has one first end and one second end and rotates in one first direction and in one second direction opposite to the first; said winding means being at least partially substantially cylindrical in shape;

one or more supports configured to rotatably support said shaft;

a plurality of motors configured to enable rotation in said first direction and in said second direction of said shaft and of said winding means;

a base frame, fixed to which are said supports and said plurality of motors wherein said plurality of motors are set on both sides of said winding means and connected to said winding means without speed-reducing elements, with direct drive on the shaft.

2. The draw-works according to claim 1, wherein said motors are brushless electric motors and comprise at least one rotor and one stator; said rotor being substantially boxed in said stator and being fixed directly to said shaft to turn integrally therewith.

3. The draw-works according to claim 2, wherein said motors have one first fluid-circulation cooling system comprising a plurality of pipes connected, respectively, to pipe fittings positioned substantially on said stator; said pipe fittings forming a fluid-tight passage with a plurality of channels for cooling the motor.

4. The draw-works according to claim 2, wherein said stator of said motors is air-tight and moreover comprises ducts for entry and exit of air connected in a fluid-tight way on said motors; said entry ducts being configured to be supplied by an air-tight duct connected with a blower spaced apart from said draw-works.

5. The draw-works according to claim 2, further comprising control means for electrical/electronic control of said motors, said control means being configured to regulate speed of rotation of said motors.

6. The draw-works according to claim 5, wherein said control means comprise controllers having inputs connected to an electrical power-supply network and outputs connected to said motors, and signal-transmission means configured to exchange data with a management system, and to monitor continuously at least said speed of said motors as a function of a level of voltage supplied by said controllers, sending modification signals to said controllers.

7. The draw-works according to claim 6, wherein said controllers drive a respective motor via a pulse-width modulation.

8. The draw-works according to claim 3, wherein said channels extend substantially in a direction parallel to a direction of rotation of said motors.

9. The draw-works according to claim 4, wherein present between said duct and said blower is a valve; said valve being designed to modify pressure of air present within the duct.

10. The draw-works according to claim 1, further comprising a plurality of braking systems comprising a plurality of brake disks set at the sides of said winding means and pivoted in a center of said winding means on said shaft, and a plurality of brake calipers configured to exert a friction on said brake disks.

11. The draw-works according to claim 10, wherein said brake calipers are fixed to said frame via a respective bracket.

12. The draw-works according to claim 10, wherein said braking systems are cooled by a second cooling system comprising a plurality of pipes communicating with at least one cooling channel having a plurality of outlets facing said brake disks.

13. The draw-works according to claim 12, wherein said at least one cooling channel is set within said shaft in a direction substantially the same as an axis of the shaft.

14. The draw-works according to claim 1, further comprising an auxiliary alternating current electric motor and a joint with automatically meshing teeth, configured to transmit the motion of the main shaft from an auxiliary electric motor to said winding means; said auxiliary electric motor being configured to operate in conditions of unreeling of the cable by said winding means.

15. The draw-works according to claim 14, wherein said auxiliary electric motor is controlled, through a dedicated control system, comprising:

in one first, constant-load, mode, a first constant load mode in which there is detected the force with which a drilling bit connected to said cable presses on the bottom of a drill hole and in which said force is regulated at a value to be kept constant;

a constant speed mode with which said winding means are made to unreel at a speed of rotation that is constant and independent of the pressure of the bit on the bottom of the drill hole;

a constant fluid pressure mode in which the speed of rotation of the winding means is regulated in such a way that the pressure of a fluid used for moving the drilling bit, is kept constant.

* * * * *